US005163594A

United States Patent [19]

Meyer

[11] Patent Number: 5,163,594

[45] Date of Patent: Nov. 17, 1992

[54] OPPOSED ARM WEB ACCUMULATOR

[75] Inventor: Thomas C. Meyer, Elkhart Lake, Wis.

[73] Assignee: Curt G. Joa, Inc., Boynton Beach, Fla.

[21] Appl. No.: 833,811

[22] Filed: Feb. 10, 1992

Related U.S. Application Data

[62] Division of Ser. No. 690,493, Apr. 24, 1991, abandoned.

[51] Int. Cl.[5] ..... B65H 20/24; B65H 19/18; B65H 59/12

[52] U.S. Cl. ..... 226/119; 242/58.1; 242/154

[58] Field of Search ..... 226/118, 119; 242/58.1, 242/75.51, 154

[56] References Cited

U.S. PATENT DOCUMENTS

| | | | |
|---|---|---|---|
| 1,605,842 | 11/1926 | Jones | 226/119 |
| 2,171,741 | 9/1939 | Cohn et al. | 226/119 X |
| 3,016,207 | 1/1962 | Comstock | 226/118 X |
| 3,024,957 | 3/1962 | Pinto | 226/119 |
| 3,053,427 | 9/1962 | Wasserman | 226/118 |
| 3,087,689 | 4/1963 | Heim | 242/154 |
| 3,091,408 | 5/1963 | Schoeneman | 226/118 X |
| 3,540,641 | 11/1970 | Besnyo | 226/118 X |
| 3,888,400 | 6/1975 | Wiig | 226/118 X |
| 4,009,815 | 3/1977 | Ericson et al. | 226/113 |
| 4,222,533 | 9/1980 | Pongracz | 242/58.3 |
| 4,603,800 | 8/1986 | Focke et al. | 226/119 |

*Primary Examiner*—Daniel P. Stodola
*Assistant Examiner*—Michael R. Mansen
*Attorney, Agent, or Firm*—Fuller, Ryan, Hohenfeldt & Kees

[57] ABSTRACT

In one embodiment of a web accumulator, at least one pneumatic cylinder actuator has a chain loop connected to opposite ends of its piston rod. Translation of the chain in response to pressurizing the cylinder causes the chain to drive two spaced apart axle shafts in the same rotational direction. An arm is fastened to each axle shaft and there is a row of rollers on each arm and a roller on each axle shaft. Web is threaded in loops back and forth between rollers on the respective arms. When the web infeed rate to the accumulator and the outfeed or rate at which the web is drawn out by a web consuming device are equal, the regulated air pressure to the actuator drives the arms apart to thereby accumulate a long length of web. When web infeed is interrupted while outfeed or draw persists, the arms are pulled toward each other and they pay out the stored length of web. In one embodiment, web tension may vary with the angles of the arms on each side of an imaginary center line to which the axes of the axle shafts are perpendicular. Compensation for such variance may be made by varying the air pressure is accordance with such angle. In the other embodiment, the chain drives the axle shafts through a lever whose radius varies along its profile, providing constant tension throughout the range of angular motion.

3 Claims, 7 Drawing Sheets

OPPOSED ARM WEB ACCUMULATOR

This is a file wrapper divisional of copending application Ser. No. 07/690,493, filed Apr. 25, 1991, now abandoned.

BACKGROUND OF THE INVENTION

The invention disclosed herein pertains to an accumulator for accumulating a substantial length of a running web such that if the infeed to the accumulator is stopped or slowed for a short interval, the web in storage is paid out continuously to a web utilizing machine so the machine has a constant supply and need not be stopped or slowed during any part of the interval.

One common use of a web accumulator is where a web is fed from a primary supply reel and it is necessary to splice the leading end of the web from a standby supply reel to the trailing end of a web from the primary supply reel in a manner which will not cause interruption of the web supply to a web consuming or utilizing device. In some known accumulators there is a row of spaced apart rollers on one swingable arm cooperating with another row of rollers which may be stationary or swingable on another arm. When the one arm with a row of spaced apart rollers on it is swung away from stationary rollers or the row of rollers on the other arm and the web is looped around the two sets of rollers, a substantial length of web can be accumulated. During normal running of the web, the arms will be urged to their maximum separation from each other for accumulating and storing the maximum length of web. If the supply of web to the accumulator is stopped for a short interval, the tension due to drawing web from the outfeed end of the accumulator causes the sets of rollers to move toward each other while the length of web in storage is paid out. After the end of the interval during which web infeed to the accumulator is stopped, the two relatively movable sets of rollers separate again to accumulate and store another length of web.

There is another general type of accumulator which has a set of rollers mounted on a movable carriage which can run linearly toward or away from a set of corresponding stationary rollers. The web is looped back and forth between the rollers on the movable and stationary components so that web is accumulated as the movable carriage moves away from the stationary assembly.

In application of web accumulators where web tension is of concern, designers must face the problems associated with friction and inertia. The consequence of these two factors may be appreciated when it is realized that the web may be running at a very high rate of speed when suddenly, for some reason, such as when making a splice, the infeeding web is stopped or decelerated. This change in web motion will result in a reaction by the components of the accumulator. Most notable of these reactions is the motion imparted to the movable assembly of the accumulator, whether swinging arm or linear carriage. Minimizing the inertia and friction associated with this reaction will minimize tension transients, and is a prime advantage of the invention described herein.

Also notable is the change in speed of the individual rollers. While roller inertia can actually be of benefit during a sudden deceleration, it must also be overcome when the infeeding web is returned to the original running speed. The roller nearest the infeed may have come to a complete stop, while each succeeding roller has slowed to some speed slightly higher than the roller preceding it. As the web at the infeed is accelerated it can only be drawn into the accumulator as fast as the rollers can resume their original speeds. Since the force to accelerate these rollers is provided only by the tension in the web, it can be seen that minimizing the number of rollers and their inertias can allow a given system to operate successfully at lower web tensions. In prior art machines, friction and inertia are significant factors which limit their usefulness at low tensions. Thus, there is an important need for a web accumulator which provides the benefits of low friction and minimized inertia, allowing it to handle the most delicate of webs at high speeds without breakage or loss of control.

SUMMARY OF THE INVENTION

In general terms, the new dual opposed arm web accumulator comprises a base on which are arranged first and second axle shafts with their axes in parallel spaced from each other along a common center line. An arm is fastened to each axle shaft for swinging in spaced apart parallel planes toward and away from each other. The arms generally present the perspective of being opposite sides of a parallelogram. Web is looped back and forth between the rollers on one arm and rollers on the other arm. Means are provided for applying a torsional force concurrently to the axle shafts which causes one of the arms to swing through an angle away from one side of the center line and the other arm to swing away through a corresponding angle from the other side of the center line until the arms attain a maximum permissible angle relative to the center line during normal running of the web. The arms also swing correspondingly toward each other as stored web in the accumulator is withdrawn from the accumulator.

One feature of the new accumulator is that the arms can swing past each other to provide an open space into which the web is threaded initially through the free space between the two sets of rollers on the arms but without the need to loop the web around the rollers. The arms are allowed to swing to opposite sides of each other again automatically to create loops which form the length of web being accumulated and stored.

Another important feature of the new accumulator is that the arms are tied together mechanically such that they are completely counterbalanced to negate the effects of gravitational forces.

Another important feature of the new accumulator is that, unlike many prior art accumulators, it contains no linear slide mechanisms, which are especially subject to misalignment, contamination, wear and the resulting friction.

Another important feature of the accumulator is that, in comparison with prior accumulators, it achieves a large amount of web storage for a given number of rollers and for the space it occupies.

How the foregoing features and other objectives of the invention are implemented will appear in the ensuing more detailed description of a preferred embodiment of the invention which will now be set forth in reference to the accompanying drawings.

DESCRIPTION OF A PREFERRED EMBODIMENT

Figure 1:
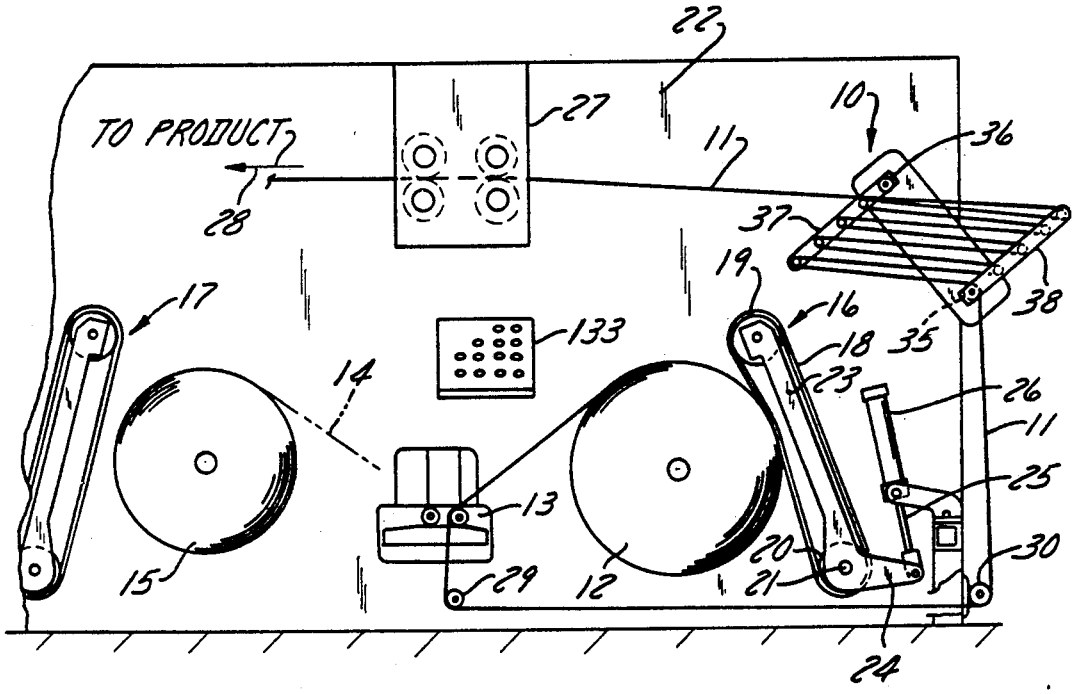
FIG. 1 is a front elevational, mostly diagrammatic, view of a web handling machine in which the new accumulator may be installed.

FIG. 1 illustrates an arrangement in which the new accumulator, generally designated by the numeral 10, can be used advantageously. In this figure, web 11 is being fed from a supply reel 12 from which the web runs to a splicer 13. The splicer may be any of a variety of conventional splicers which can join the leading end 14 of a web from a standby supply reel 15 to the trailing end of the web from the primary supply reel when the web is just about ready to run out from the primary supply reel. Reel drivers 16 and 17 are provided for rotating the primary and standby supply reels, respectively, for the purpose of feeding out the web to the accumulator downstream. Typical reel driver 16 comprises a belt 18 running on rollers 19 and 20. Roller 20 is fixed to a shaft 21 which is driven rotationally by a motor, not visible, which is behind the front plate 22 of the machine. The belt and rollers are carried on a frame 23 which has an arm 24 connected to the piston rod 25 of a pneumatic actuator 26. The actuator 26 is used to push the belt 18 into frictional driving relationship with the periphery of roll of web on the supply reel. This supply reel drive device 16 is a well known type. After the web passes through accumulator 10 it goes through a metering device 27 which is symbolically represented. From the metering device, the web is drawn in the direction of the arrow 28 into a web utilizing device, not shown, which could be a disposable diaper making machine.

Normally, the web 11 after leaving splicer 13, will continue over idler rollers 29 and 30 to the infeed roller 35 of the accumulator 10. And, after being looped back and forth in the accumulator to lengthen the amount of web in storage, the web continues from the outfeed roller 36 of accumulator 10.

When the web on primary supply reel 12 is depleted to the extent that its trailing end is about to unwind from the reel, drive 16 decelerates reel 12 so as to bring it to a stop, at which time the splicer 13 splices the leading end of the web on reel 15 to the expiring web. It is quite typical that conventional splicers would simultaneously sever the expiring web, leaving what is now a continuous web running from the reel 15 through to the web accumulator. After a short interval, during which said splicing action occurs, the run of web between splicer 13 and the infeed roller 35 is not moving, and is under essentially the same tension as it is in regular feeding of the web. Of course, at this time the great length of web which is formed within the several loops in the accumulator is being paid out of the accumulator from outfeed roller 36.

Figure 2:
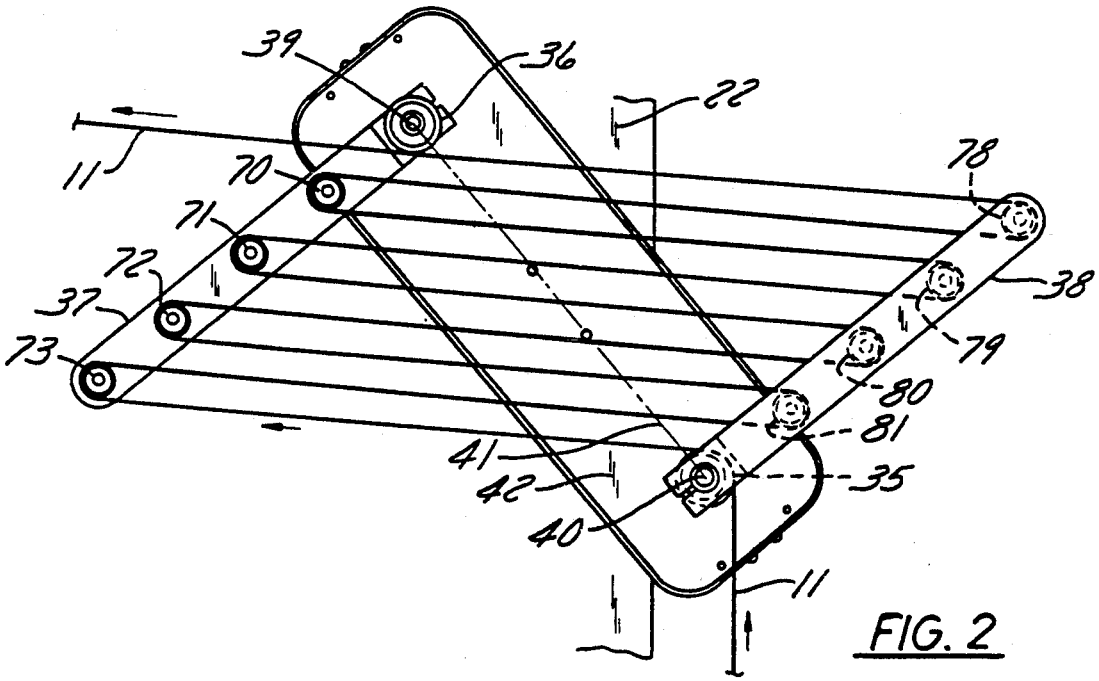
FIG. 2 is a front elevational view of the accumulator with its roller carrying arms angulated to the position in which the maximum length of web is accumulated.

Attention is now invited to FIG. 2 wherein the parts of the accumulator are in the position in which they would be during storage of the maximum amount of web as is the case when the web is being drawn out of the accumulator and is being fed into the accumulator at the same rate. In other words, in this example, the swinging arms 37 and 38 are swung apart as far as is practical in FIG. 2 to store the maximum amount of web 11 in the form of loops running back and forth between the arms. Arms 37 and 38 are clamped to axle shafts 39 and 40, respectively, for rotating with the axle shafts. The axes of the axle shafts 39 and 40 lie on a center line which is marked 41 in FIG. 2. As will be explained shortly hereinafter, axle shafts 39 and 40 are driven apart in unison so that the arms always maintain the same angular separation from common center line 41. The arms 37 and 38 turn clockwise together and counterclockwise together.

Figure 4:
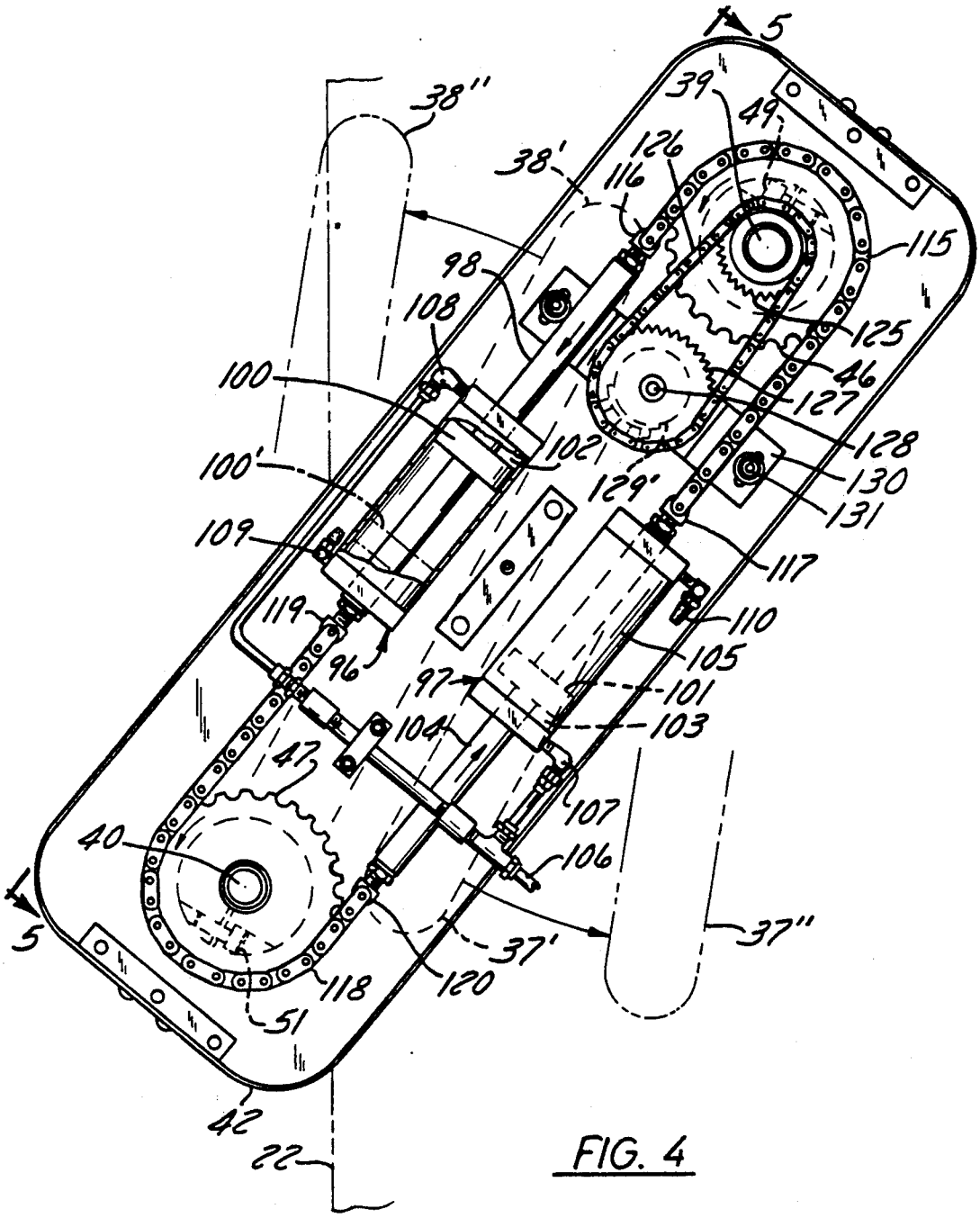
FIG. 4 is a view taken on the line 4—4 in FIG. 5 of the mechanism for driving the arms apart in unison to effect accumulation of a length of web.
Figure 5:
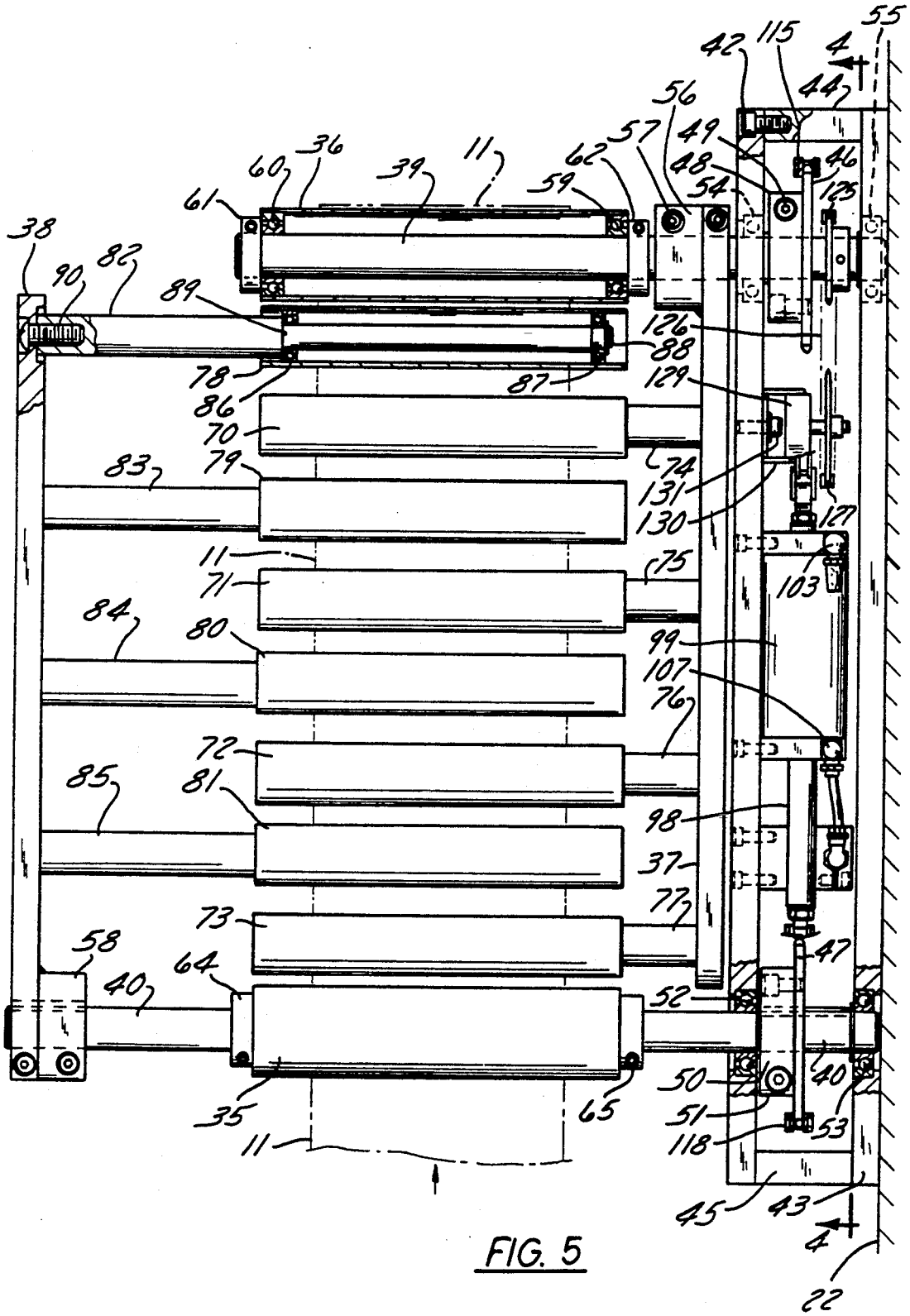
FIG. 5 is a side elevational view taken on the line 5—5 in FIG. 4, of the assembled accumulator with some parts being shown in section.

Attention is now invited to FIGS. 2, 4 and 5 for a discussion of how the arms are driven apart to bring about the accumulation of web and how the arms swing toward each other to pay out accumulated web to the outfeed when infeed of web is stopped for a short interval. First refer to FIG. 4 which shows that the mechanism for operating the arms 37 and 38 is contained within a housing whose front wall 42 appears in FIG. 4 and whose rear wall 43 appears in FIG. 5. In the latter figure the end walls 44 and 45 of the housing are also visible. The housing is much like a box whose rear wall 43 is fastened to the front face plate 22 of the machine depicted in FIG. 1.

Considering FIGS. 4 and 5, primarily, one may see that the rotatable axle shafts 39 and 40 have tooth wheels in the form of sprockets 46 and 47 fastened to them. Sprocket 46 is bolted to a clamp 48 which provides for clamping the sprocket to axle shaft 39 by way of tightening a clamping screw 49. A key and keyway, not visible, may also engage the sprocket to the axle shaft. The other sprocket 47 is similarly bolted to a clamping member 50 which is provided with a screw 51 which can be tightened to clamp the sprocket to axle shaft 40. Axle shaft 40 is journaled in ball bearings 52 and 53 which are set in suitable counterbored holes in the front and rear walls 42 and 43, respectively, of the drive mechanism housing. The other axle shaft 39 is similarly journaled for rotation in ball bearings 54 and 55. Swinging arm 37 is clamped to axle shaft 39 by means of a clamping element 56 which is essentially a split ring that is engaged to the shaft by tightening a machine screw 57. Swinging arm 38 is similarly clamped to axle shaft 40 by means of a clamping member 58. The previously mentioned outfeed roller 36 is shown in FIG. 5 to be journaled for rotation on axle shaft 39 by means of two internal bearings 59 and 60.

The roller is secured against shifting axially by collars 61 and 62 which are clamped to axle shaft 39. Tubular outfeed roller 36 is preferably composed of a strong lightweight material so the roller has low inertia and requires the least amount of torque to start and stop. Previously mentioned infeed roller 35, as shown in FIG. 5, is journaled for rotation on axle shaft 40 Roller 35 is prevented shifting axially on axle shaft 40 by means of axially spaced apart collars 64 and 65 which are clamped to axle shaft 40. From inspection of FIGURE 5, it will be evident that arms 37 and 38 swing in planes which are parallel to each other.

Referring further to FIG. 5, arm 37 has mounted to it several rollers 70, 71, 72 and 73. These rollers are freely rotatable on respective shafts 74, 75, 76 and 77. Arm 38 has mounted to it an equal number of rollers 78–81. These rollers are mounted for rotation on respective shafts 82, 83, 84 and 85. Roller 78 is typical. It is also preferably composed of a lightweight rigid material for the sake of minimizing inertia. Roller 78 is journaled for rotation on shaft 82 by means of two ball bearings 86 and 87. The outboard end of shaft 82 is provided with a c-ring 88 for retaining bearing 87 on the shaft. The other bearing 86 is pressed on the shaft and retained against axial movement by abutting a shoulder 9 on the shaft 82. Typical roller shaft 82 is mounted to arm 38 by means of a machine screw 90.

As will be explained in detail later, arms 37 and 38 are driven rotationally, in this illustrative embodiment, by means of two pneumatic actuators 96 and 97, whose piston rods 98 and 104 are interconnected by two chains 115 and 118. The chains engage the toothed wheels or sprockets 46 and 47 for rotating the axle shafts 39 and 40 and the arms 37 and 38 thereon to accumulate web in response to movement of the pistons 100 and 101. When infeed of web to the accumulator stops, the continued draw on the web at the outfeed causes the arms to swing toward each other. Two pneumatic actuators 96 and 97 are illustrated but it should be understood that either actuator could be removed and replaced with a section of chain and the remaining actuator could be replaced by a single actuator of sufficiently larger piston area to produce the actuating force which is the sum of the forces of the two actuators.

Figure 7:
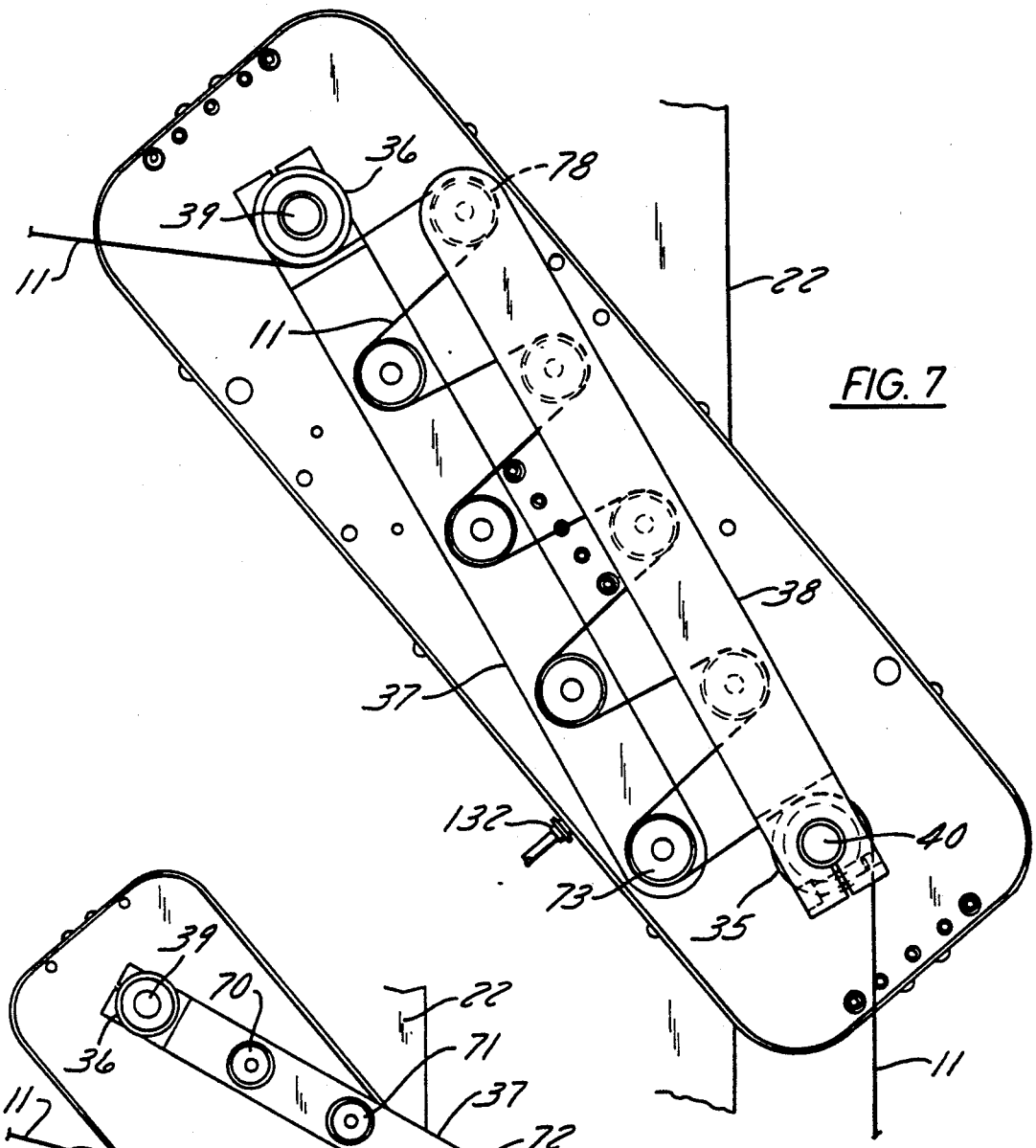
FIG. 7 shows the position of the arms immediately after the web has been threaded into the accumulator and separation of the arms is underway to increase the length of the web which is to be held in storage.

In FIG. 2, arms 37 and 38 are both rotated through an angle relative to imaginary center line 41 which provides for storing the maximum length of web 11 in the loops of web spanning between the arms. Arms 37 and 38 are swung by the greatest angular amount as in FIG. 2 when web 11 is being fed into infeed roll 35 and is being drawn out of the accumulator over outfeed roll 36. In FIG. 7, arms 37 and 38 are swung close to each other which is a condition that occurs when infeed of web 11 is stopped and the accumulator has paid out just about all of the web it is permitted to pay out over the outfeed roller 36 before infeed of web must continue The manner in which the arms 37 and 38 are induced to swing out as in FIG. 2 for storing the maximum amount and are allowed to yield toward each other as in FIG. 7 to give up the stored amount of web will now be discussed in more detail in reference to FIGS. 4 and 5.

As previously mentioned in respect to FIG. 4, a sprocket 47 is fastened to axle shaft 40 for the infeed roller 36 and another sprocket 46 is fastened to the outfeed roller axle shaft 39. Two pneumatic actuators 96 and 97 are mounted to the wall 42 of the housing. Actuator 96 has a piston rod 98 which extends slidably and sealably through both ends of the cylinder of actuator 96. The piston fixed to rod 98 is drawn in solid lines and is marked 100. Under ordinary operating conditions, that is, when arms 37 and 38 are swung through the maximum angle relative to center line 41, piston 100 will be shifted by air pressure to its phantom line position designated by the numeral 100'. Actuator 97 is similar to actuator 96. They drive and yield together and each contributes one-half of the force for swinging arms 37 and 38. Thus, when the piston 100 in actuator 96 is in its solid line position, piston 101 in actuator 97 is positioned as shown in hidden lines. The volume 102 on one side of piston 100 is occupied by air under pressure under all operating conditions of the accumulator. The pressure tends to force piston 100 to the left to develop a force which is translated to web tension. Similarly, when the volume 103 on the left side of piston 101 in actuator 97 is subjected to the same air pressure, piston 101 is biased to the right in FIG. 4. The piston rod 104 of actuator 97 also extends through both ends of the actuator cylinder 105. Pressurized air is supplied to the pressurizing volumes 102 and 103 of the actuators through a supply line 106. The pressurized air enters actuator 97 by way of inlet elbow 107 and pressurized air enters actuator 96 through an elbow 108. There are filter devices 109 and 110 connected to the respective cylinders 99 and 105 to allow exhaust of air when the pistons shift from their home position as depicted in FIG. 4. The filters also prevent air containing contaminants from being drawn into the actuator cylinders when the pistons retract to their home positions depicted in FIG. 4. A flexible member in the form of a chain 115 has one of its end 116 connected to an end of piston rod 98 of actuator 96 and has its other end 117 connected to an end of piston rod 104 of actuator 97. Chain 115 is engaged with sprocket 46 for driving axle shaft 39. Another chain 118, has one of its ends 119 fastened to piston rod 98 of actuator 96 and the other of its ends 120 fastened to the piston rod 104 of actuator 97. It would be possible to use toothed pulleys in place of sprockets 46 and 47 and to use toothed timing belts in conjunction with the pulleys instead of using chains.

Figure 3:
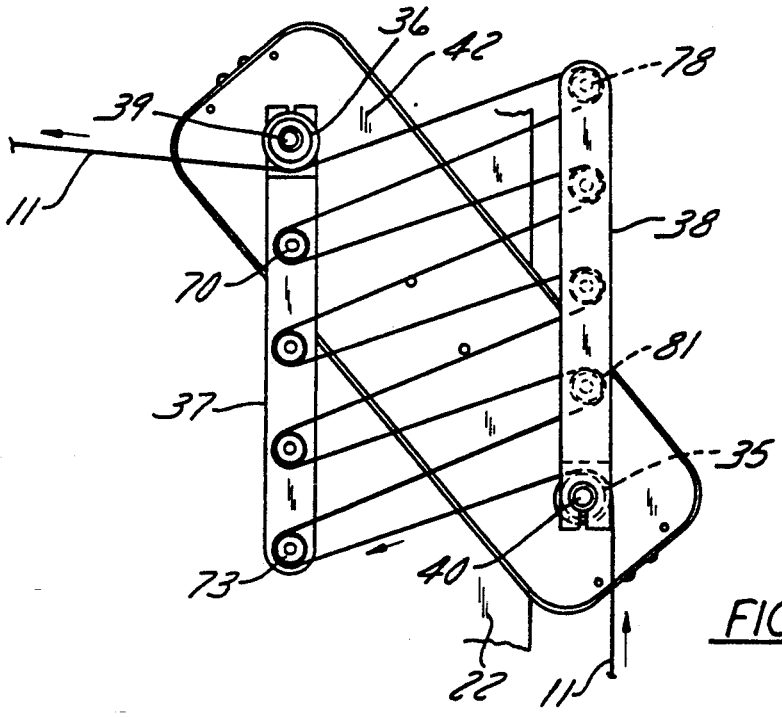
FIG. 3 is similar to FIG. 2 except that the arms of the accumulator would be moving towards each other as would be the case when infeed of web is stopped and the great length of web which is stored in the accumulator is being paid out.

It will be evident that when air pressure is applied in volumes 102 and 103 of actuators 96 and 97, respectively, pistons 100 and 101 will shift in opposite directions and the chains running on sprockets 46 and 47 will drive axle shafts 39 and 40 and the arms 37 and 38 thereon in unison. When pistons 100 and 101 are in the positions in which they are depicted in FIG. 4, arms 37 and 38 are departed by the least angular amount from the center line which extends between the axes of axle shafts 39 and 40. As the pistons begin to move, the arm 38 passes through a position represented by phantom lines and marked 38'' and the other arm 37 moves through an angular position represented by the phantom lines marked 37''. When the arms are in the position represented by phantom lines 37'' and 38'' they are positioned approximately as depicted in FIG. 3.

During normal operating conditions, that is, when the infeed of web to the accumulator corresponds with the outfeed of web, the arms 37 and 38 rotate to the position in which they are depicted in FIG. 2 wherein they store the maximum amount of web in the loops between the rollers 70–73 and 78–81 on the respective arms 37 and 38. In typical applications, the web is fed into the accumulator at a speed regulated by the position of the arms. This will cause the infeed web speed to equal outfeed web speed when the arms are positioned for optimum web storage. This will place the arms approximately as shown in FIG. 2, with the air cylinder piston 100 at position 100', as shown in FIG. 4. Under any condition of infeed and outfeed velocities, the force developed by the actuators 96 and 97 is translated to rotational forces in the arms and resultant tension in the web. If outfeed velocity exceeds infeed velocity, the differential in web travel will tend to move the arms a backwardly, compressing the air in the cylinders. Pressure regulating devices (not shown) limit the increase in pressure in the cylinders and therefore regulate the tension.

It should be noted that since the axle shafts 39 and 40 for the arms are driven together the arms always will counterbalance each other. It should also be noted that the shafts and the arms swing clockwise together as they are accumulating a length of web loops between them and that they rotate counterclockwise together when infeed of web is interrupted and outfeed continues as a result of web being drawn by whatever web consuming or utilizing device is being supplied with the web from the accumulator.

Observe in FIGS. 4 and 5 that there is another sprocket 125 fastened to axle shaft 39. A chain loop 126 runs over the sprocket for the purpose of driving another sprocket 127. Sprocket 127 is fastened to the shaft 128 of a potentiometer 129. The lead wires of the potentiometer not shown. The potentiometer is supported on a bracket 130 which is clamped to the front wall 42 of the drive mechanism housing by means of machine bolts, such as the one marked 131, which pass through slotted holes in the bracket to provide for shifting the potentiometer until the proper tension is obtained in chain 126.

The potentiometer produces an analog signal relating to the angular position of the arms. This analog signal is typically supplied to the infeed device's web speed controller, not shown. In the application depicted in FIG. 1, the motor being controlled is the previously mentioned motor coupled to the shaft 21 of the belt drive mechanism 16. If, during regular operation, draw of web at the outfeed of the accumulator 10 increases such as to cause an angular change in the arm position of the accumulator, for example, the controller will cause the motor which drives the belt drive 16 to run faster until normal arm position is restored.

Figure 6:
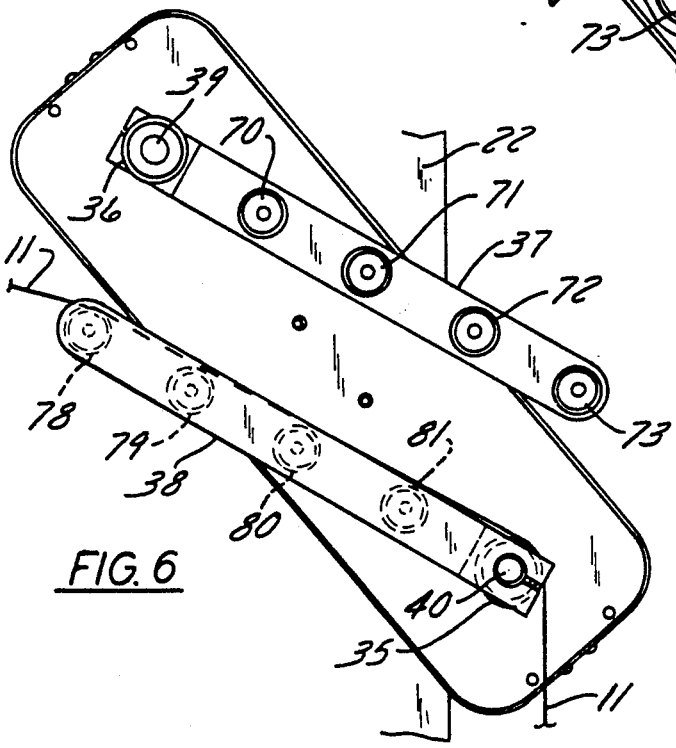
FIG. 6 shows the two arms of the accumulator swung past each other to provide a clear passageway for threading the web into the accumulator at the start of a web run.

A feature of the invention is the ease with which the web can be threaded through the accumulator to begin a web run without the need for zigzagging the web around the rollers on the arms 37 and 38. Attention is invited to FIG. 6. Here it will be noted that arms 37 and 38 are crossed over each other as compared with their angular positions in FIG. 2 and 3, for example. Cross-over can be effected by grasping the outboard end of arm 38, for example, and drawing it past arm 37. Because the arms swing through an angle relative to the imaginary center line which runs through the axes of shafts 39 and 40 and the rollers on each of the arms are offset from each other as they pass the center line, the rollers on one arm can pass through the space between rollers on the other arms. When the arms are crossed over and spaced apart as they are in FIG. 6, it will be evident that the web 11 can be arranged as indicated without the need for making as much as a semi-circular loop around any of the rollers. Cylinders 99 and 105 of actuators 96 and 97 can have the normal air pressure applied to them at the time one arm is swung past the other manually. On the other hand, the actuator cylinders 99 and 105 can be unpressurized before a web run starts so only a small manual force is needed to cause them to cross over. It will now be appreciated why, during normal operation, when the arms are not crossed over, a free space remains between the end of actuator cylinder 99 and the displaced piston 100'. When the arm 38 is urged into cross-over position as explained in reference to FIG. 6, piston 100' is compelled to over travel and almost abut the adjacent end of the actuator cylinder. This amount of travel is all that is necessary to turn the axle shafts 39 and 40 enough to cause the rollers on the two arms to pass each other. Of course, since the arms are mechanically interconnected by means of the chains when the arm, such as 38, swings through a small angle, the other arm 37 swings through a corresponding angle in the other direction relative to the center line and a small amount of movement of one arm provides a rather large gap between arms for threading the web through the accumulator when setting up for a run of the machine.

In FIG. 7, manually deflected arm 38 has been released and tension is being applied to the web which causes the arms to swing past each other again. The arms then slowly swing away from each other in response to the pressure that is applied to the pistons in the pneumatic actuators 96 and 97.

Figure 8:
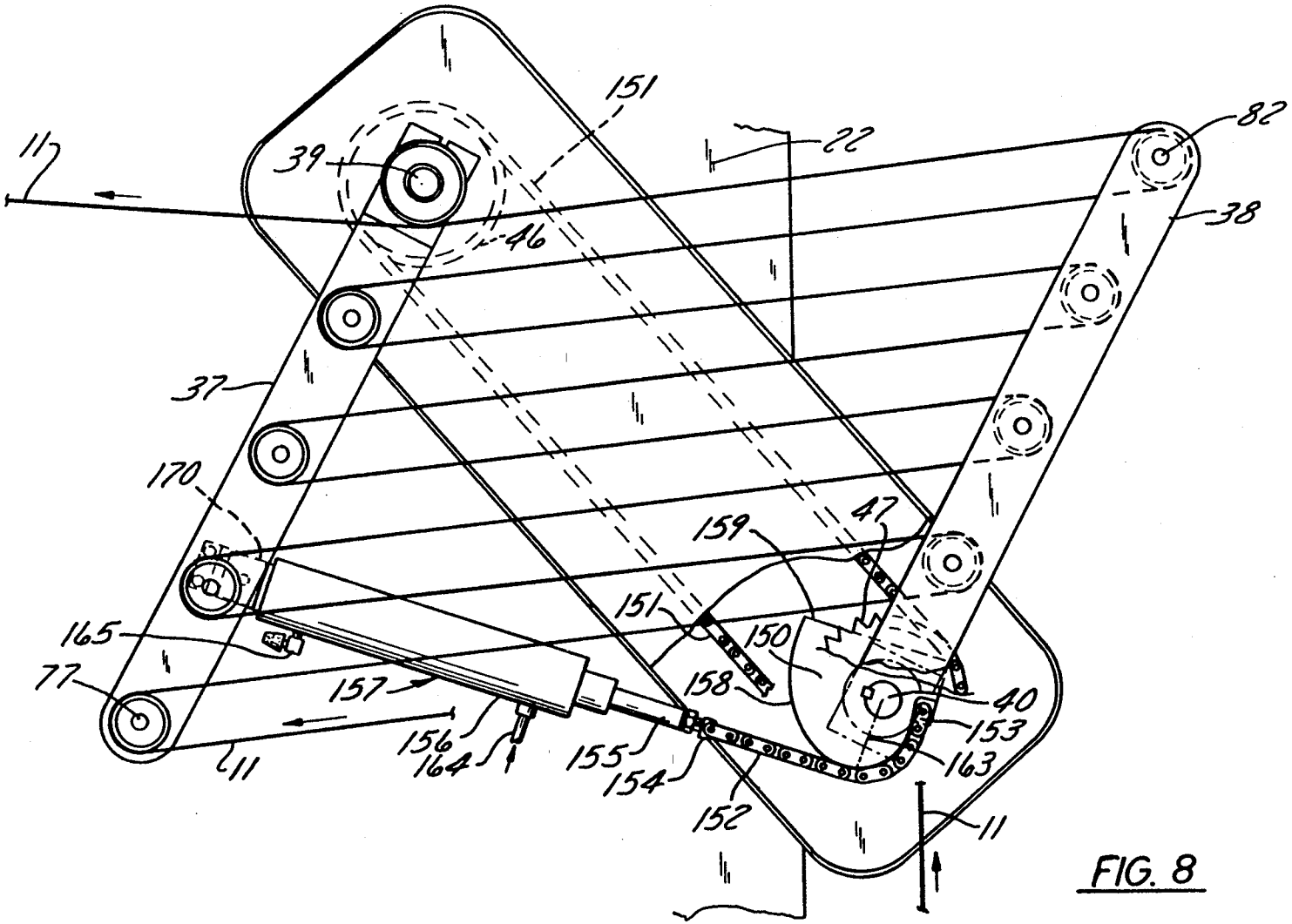
FIG. 8 is a front elevational view of an alternate but preferred embodiment of the new accumulator.
Figure 9:
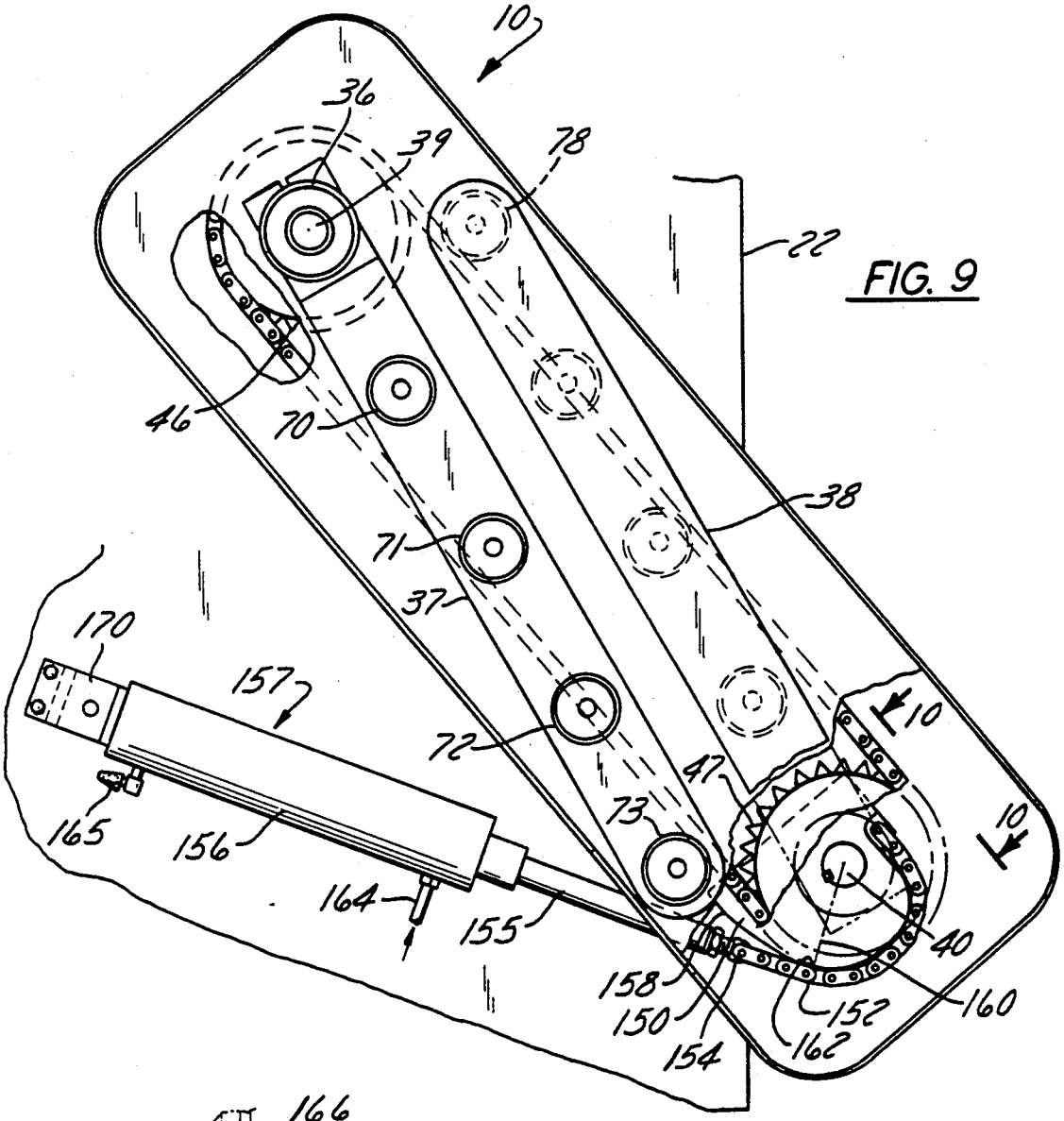
FIG. 9 is similar to FIG. 8 except that the arms are swung to a position wherein a substantially minimum amount of web would be in storage.
Figure 10:
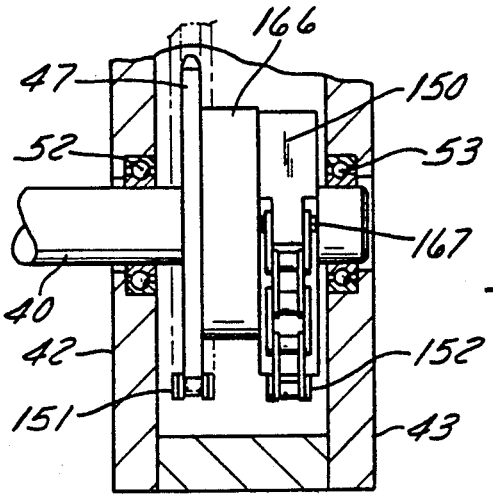
FIG. 10 is a view, partly in section, taken on a line corresponding with 10—10 in FIG. 9.

In the FIG. 1–7 embodiment of the invention, the actual tension induced in the web by the torsional force applied to the arms is a trigonometric function of the angular relationship between the various web strands and the arms. As the angle between web and arm is varied from the perpendicular, relatively constant web tension can be achieved, for example, by having a microprocessor based controller, not shown, vary the actuator pressure in dependence on the signal received from the potentiometer 129. An alternative embodiment of the accumulator depicted in FIGS. 8–10 overcomes the variable torque requirement by a purely mechanical rather than electrical method. In FIGS. 8–10 parts which are similar to parts identified in the previously discussed embodiment are given the same reference numerals In this embodiment, a varying radius cam 150 is fastened to axle shaft 40 along with sprocket 47. A closed loop chain 151 wraps around sprocket 47 and also around sprocket 46 which is on the other axle shaft 49. It will be evident that when one sprocket is forced to turn the other will turn through the same angle and the arms 37 and 38 will swing through a corresponding angle relative to a line passing through the centers of axle shafts 39 and 40. A short piece of chain 152 is fastened at one end 153 to the cam and is fastened at the other of its end 154 to the end of a piston rod 155. Piston rod 155 extends from the cylinder 156 of a pneumatic actuator 157. Cylinder 156 can swivel on a bracket 170. The cylinder has an inlet 164 for pressurized air and a filter-muffler 165. The end 153 of the chain 152 attaches to the curved cam 150 at the place where the radius of the profile 158 of the cam is minimum. The radius of the cam increases continually from the point 153 to the end 159 of the cam where the radius of the cam is largest. The effective radius or moment of rotation arm is that point at which the chain becomes tangent to the cam profile 158. From this, it can be seen that a constant force applied by the pneumatic actuator can produce a torsional force in the arms which varies with angular position. The varying radii of the cam are selected to compensate for the varying force vector between the web and arm angles, resulting in an effectively constant web tension, regardless of arm position.

FIG. 9 illustrates this situation where the chain 152 is tangent to the profile 158 of the cam at a point marked 162. The radius of the cam at this point is marked 160. In FIG. 8 the radius extending from the center of shaft 40 to the point of tangency between the chain and the profile 158 of the cam is marked 163. It will be evident that the radius 160 in FIG. 9 where the arms are close to each other is substantially greater than the radius 163 in FIG. 8 where the arms 37 and 38 are angulated farther apart in FIG. 8 than they are in FIG. 9. Since the air pressure driving the piston in actuator cylinder 156 is held substantially constant, it will be evident that the tension force in the chain 152 multiplied by the torque radius 163 in FIG. 8 will result in a torque related to the constant tension in chain 152 multiplied by torque arm 160.

The pressurized air is supplied to actuator cylinder 156 through a tube 164. The cylinder is also provided with a combination muffler and filter 165 which prevents contaminated air being drawn into the cylinder 156 when the piston moves in opposition to the air pressure due to arms 37 and 38 being forced toward each other while web infeed is stopped for an interval.

FIG. 10 show how axle shaft 40 is journaled for rotation in ball bearings 52 and 53 which are set in walls 42 and 43 of the mechanism housing as is the case in the previously described embodiment. In FIG. 10, however, cam 150 is fastened to shaft 40 and sprocket 47 is fastened to a member 166. Chain 152 is pivotally connected to cam 150 with a pin 167 as is evident from inspection.

It should be understood that actuators which differ from the two pneumatic actuators 96 and 97 in the FIG. 4 embodiment and the single actuator 157 in the FIG. 9 embodiment can be employed to swing arms 37 and 38 apart and have the arms swing toward each other. For example, a version of the accumulator, not illustrated, has ben constructed and satisfactorily operated wherein a torsion spring, not shown, serves as the actuator. The torsion spring has one end fixed and its other end fastener to one of the axle shafts 39 or 40. During regular web transport the preloaded torsion spring causes the arms 37 and 38 to swing away from opposite sides of the center line. When infeed of web to the accumulator is slowed or stopped and outfeed continues, web tension in the outfeed overcomes the torsional force of the spring so the arms swing toward each other and pay out stored web. Both arms are driven in unison by having a closed loop chain connecting sprockets on the axle shafts.

In another embodiment which is not illustrated, a commercially available torque motor is mechanically coupled to one of the axle shafts. The axle shafts are connected for being driven in unison by a closed loop chain. Using an appropriate commercially available programmable controller, the torque motor can be caused to vary its torque in accordance with its rotational angle.

Although two implementations of the concepts of the new accumulator have been described in detail, such description is intended to be illustrative rather than limiting, for the invention maybe variously modified and is to be limited only by interpretation of the claims which follow.

I claim:

1. A web accumulator comprising:

a base, first and second axle arranged with their axes in parallelism and journaled for turning relative to said base, the axes of the axle shafts being spaced from each other along a common centerline, first and second arms fastened to said axle shafts, respectively, for swinging in spaced apart parallel planes in response to turning of said axles shafts, said arms extending in generally opposite directions from the respective shaft axes, first and second wheel means fastened to said first and second axle shafts, respectively, a flexible member formed in a closed loop around both of said wheel means and engaged with said wheel means for turning said wheel means and the arms with said axle shafts concurrently through the same angle in response to translation of said flexible member resulting from one axle shaft being driven rotationally, a torque arm fastened to one axle shaft and having a curved profile surface whose radius of curvature about the axis of said axle shaft varies over the length of the surface, a force producing actuator, a flexible element connected between said actuator and said curved surface for said flexible element to be maintained in tangential contact with said curved surface at points along said surface having radii of different lengths as said torque arm is rotated due to tension developed in said flexible element resulting from actuation of said actuator, rotation of said torque arm driving said one axle shaft rotationally to cause said one arm to swing through an angle away from one side of said centerline and the other arm to swing away through a corresponding angle from the other side of said centerline until the arms attain a predetermined maximum angle, changes in the moment of force defined by the length of the radius at the point of tangency times the tension in the flexible element causing the torsional force on the axle shaft and first and second arms to vary in correspondence with the angle of the arms with respect to said centerline, a web infeed roller rotatable on the first axle shaft and web outfeed roller rotatable on the second axle shaft, a series of spaced apart additional rollers supported on each arm, the rollers on one arm extending from the plane in which the one arm swings toward the plane in which the other arm swings, the ends of the rollers opposite from the arm on which they are supported being free to provide for a web being looped around rollers on opposite arms in succession from said web infeed roller to said web outfeed roller such that the maximum length of web accumulated in said accumulator occurs when arms are swung to their said maximum angle.

2. The web accumulator according to claim 1 wherein said flexible member is a roller chain and said wheel means are sprockets.

3. The accumulator according to claim 1 wherein the actuator is operated with pressurized air.

* * * * *

UNITED STATES PATENT AND TRADEMARK OFFICE

CERTIFICATE OF CORRECTION

PATENT NO. : 5,163,594
DATED : November 17, 1992
INVENTOR(S) : Thomas C. Meyer

It is certified that error appears in the above-indentified patent and that said Letters Patent is hereby corrected as shown below:

Column 10, claim 1, line 3, after "second axle" insert --shafts--.

Signed and Sealed this

First Day of February, 1994

Bruce Lehman

*Attest:*

BRUCE LEHMAN

*Attesting Officer*

*Commissioner of Patents and Trademarks*